US008808463B2

(12) United States Patent
Rolek et al.

(10) Patent No.: US 8,808,463 B2
(45) Date of Patent: Aug. 19, 2014

(54) METHOD OF RECYCLING A RINSE AID TO PRECONDITION SOILS

(75) Inventors: Robert J. Rolek, Saint Joseph, MI (US); Cristian A. Soto, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 577 days.

(21) Appl. No.: 12/473,330

(22) Filed: May 28, 2009

(65) Prior Publication Data

US 2010/0300487 A1 Dec. 2, 2010

(51) Int. Cl.

| | |
|---|---|
| ***B08B 9/08*** | (2006.01) |
| ***B08B 9/20*** | (2006.01) |
| ***B08B 3/00*** | (2006.01) |
| ***B08B 7/04*** | (2006.01) |
| ***A47L 15/00*** | (2006.01) |
| ***A47L 15/42*** | (2006.01) |
| ***A47L 15/44*** | (2006.01) |

(52) U.S. Cl.

CPC ..... *A47L 15/0002* (2013.01); *A47L 15/0005* (2013.01); *A47L 15/0007* (2013.01); *A47L 15/4236* (2013.01); *A47L 15/4276* (2013.01); *A47L 15/44* (2013.01)

USPC ..... 134/25.2; 134/10; 134/26

(58) Field of Classification Search

CPC ..... A47L 15/0002; A47L 15/0005; A47L 15/0007; A47L 15/0018; A47L 15/0021; A47L 15/0026; A47L 15/4236; A47L 15/42444; A47L 15/4276; A47L 15/44; A47L 15/46

USPC ..... 134/25.2, 26, 10, 56 D, 57 D, 58 D, 28, 134/29

See application file for complete search history.

(56) References Cited

U.S. PATENT DOCUMENTS

| | | | | | |
|---|---|---|---|---|---|
| 4,106,517 | A | * | 8/1978 | Wright | 134/58 D |
| RE30,537 | E | * | 3/1981 | Fraula et al. | 134/10 |
| 4,418,398 | A | * | 11/1983 | Hornung | 713/100 |
| 4,776,891 | A | * | 10/1988 | Murtha | 134/25.2 |
| 4,810,306 | A | * | 3/1989 | Noren | 134/25.2 |
| 5,365,959 | A | * | 11/1994 | Favaro | 134/113 |
| 5,429,679 | A | * | 7/1995 | Young, Jr. | 134/25.2 |

(Continued)

FOREIGN PATENT DOCUMENTS

| | | | |
|---|---|---|---|
| DE | 4004057 | A1 | 8/1991 |
| DE | 4243605 | A1 * | 6/1994 |

(Continued)

OTHER PUBLICATIONS

German Search Report for Counterpart DE102010016130, Jan. 16, 2014.

*Primary Examiner* — Alexander Markoff

(57) ABSTRACT

A method of preconditioning soils on wares in a dishwasher between successive wash cycles of the dishwasher includes retaining a fluid containing a rinse aid from an initial wash cycle of a dishwasher and applying at least a portion of the fluid containing the rinse aid to soils on wares in the dishwasher before the start of a subsequent wash cycle of the dishwasher. Application of at least a portion of the fluid containing the rinse aid to soils on wares in the dishwasher may be in response to the occurrence of an event. Dishwashers which retain a fluid containing a rinse aid from an initial wash cycle and apply at least a portion of the fluid containing the rinse aid to soils on wares before the start of a subsequent wash cycle are also disclosed.

16 Claims, 9 Drawing Sheets

(56) References Cited

U.S. PATENT DOCUMENTS

| | | | | |
|---|---|---|---|---|
| 5,501,742 | A | 3/1996 | Fernholz | |
| 5,601,660 | A | 2/1997 | Jeon et al. | |
| 5,669,983 | A | 9/1997 | Cooper et al. | |
| 5,730,805 | A | 3/1998 | Bertsch et al. | |
| 5,899,215 | A | 5/1999 | Parker, III et al. | |
| 6,001,190 | A | 12/1999 | El-Shoubary et al. | |
| 6,007,640 | A * | 12/1999 | Neff et al. | 134/18 |
| 6,343,611 | B1 | 2/2002 | El-Shoubary et al. | |
| 2003/0078182 | A1 * | 4/2003 | Kischkel et al. | 510/421 |
| 2004/0111807 | A1 * | 6/2004 | Jung et al. | 8/158 |
| 2004/0231710 | A1 * | 11/2004 | Dingler et al. | 134/93 |
| 2005/0101516 | A1 * | 5/2005 | Kieffer et al. | 510/514 |
| 2005/0133064 | A1 * | 6/2005 | Rosenbauer | 134/18 |
| 2006/0060225 | A1 | 3/2006 | Han et al. | |
| 2007/0034234 | A1 | 2/2007 | Holzman et al. | |
| 2007/0277854 | A1 * | 12/2007 | Eiermann et al. | 134/18 |
| 2008/0092931 | A1 * | 4/2008 | Karaaslan | 134/57 D |
| 2008/0274940 | A1 * | 11/2008 | Tjelta et al. | 510/445 |
| 2008/0274942 | A1 * | 11/2008 | Tjelta et al. | 510/445 |
| 2010/0139720 | A1 * | 6/2010 | Beaudet et al. | 134/57 D |

FOREIGN PATENT DOCUMENTS

| | | | |
|---|---|---|---|
| DE | 19906791 | A1 | 8/2000 |
| DE | 10360906 | A1 | 7/2005 |
| DE | 102007042863 | A1 | 3/2009 |
| EP | 914799 | A1 * | 5/1999 |
| WO | WO 2006082552 | A1 * | 8/2006 |

* cited by examiner

METHOD OF RECYCLING A RINSE AID TO PRECONDITION SOILS

TECHNICAL FIELD

The present disclosure relates generally to a method of operating a dishwasher and, more particularly, to a method of recycling a rinse aid to precondition soils on wares in a dishwasher.

BACKGROUND

A dishwasher is an appliance into which wares, such as dishes and other cooking and eating wares (e.g., plates, bowls, glasses, flatware, pots, pans, bowls, etcetera) are placed to be washed. A dishwasher includes a number of dish racks which support such wares. Some dishwashers employ a rinse chemistry which includes a rinse aid during a wash cycle.

SUMMARY

According to one aspect, a method of preconditioning soils on wares in a dishwasher between successive wash cycles of the dishwasher is disclosed. The method may include retaining a fluid containing a rinse aid from an initial wash cycle of a dishwasher. The method may also include applying at least a portion of the fluid containing the rinse aid onto soils on wares in the dishwasher, before the start of a subsequent wash cycle of the dishwasher. The fluid containing the rinse aid may comprise a surfactant and a sanitizing chemical.

In some embodiments, the method may include storing at least some of a rinse chemistry used in a rinsing stage of the initial wash cycle in a sump of the dishwasher, the rinse chemistry including water and rinse aid. At least a portion of the rinse chemistry may be applied to soils on wares through a rotating spray arm used during a wash cycle of the dishwasher. In other embodiments, the method may also include storing at least some of the rinse chemistry in a dedicated reservoir of the dishwasher and/or spraying at least a portion of the fluid containing the rinse aid through at least one dedicated nozzle.

The method may include monitoring the level of bacteria in the fluid containing the rinse aid after the fluid is retained, in some embodiments, and applying the fluid containing the rinse aid to the soils on the wares only if the level of bacteria is below a predetermined threshold. The fluid containing the rinse aid may be drained if the level of bacteria is above the predetermined threshold. The method may include adding an additional quantity of rinse aid to the fluid if the level of bacteria is above the predetermined threshold.

According to another aspect, a method of preconditioning soils on wares in a dishwasher between successive wash cycles of the dishwasher may include retaining a fluid containing a rinse aid from an initial wash cycle of a dishwasher. The method may also include applying at least a portion of the fluid containing the rinse aid to soils on wares in the dishwasher, in response to the occurrence of an event and before the start of a subsequent wash cycle of the dishwasher.

In some embodiments, the event which causes the dishwasher to apply at least a portion of the fluid containing the rinse aid may be transmission of an activation signal from a user control panel. The event may be the lapse of a predetermined period of time after an opening and closing of a door of the dishwasher and/or after a prior application of at least a portion of the fluid containing the rinse aid to the soiled wares. The event may also be the detection of an odor in the dishwasher, which may include an output signal of an electrochemical sensor reaching a predetermined threshold.

According to yet another aspect, a dishwasher which includes a tub defining a washing chamber is disclosed. A sump may be formed in a bottom wall of the tub. The dishwasher may include a rotating spray arm and a number of dish racks positioned in the washing chamber. A first pump, in communication with the sump, may be operable to drain liquids from the sump when energized and to retain liquids in the sump when de-energized. A second pump, in communication with the sump and the rotating spray arm, may be operable to circulate liquids from the sump through the rotating spray arm onto the number of dish racks when energized. The dishwasher may include a controller configured to operate the first pump and the second pump such that a fluid containing a rinse aid is retained from an initial wash cycle of the dishwasher and at least a portion of the fluid containing the rinse aid is applied to the number of dish racks before the start of a subsequent wash cycle of the dishwasher.

In some embodiments, the controller may be configured to operate the first pump and the second pump such that the fluid containing the rinse aid is retained in the sump and at least a portion of the fluid containing the rinse aid is applied through the rotating spray arm to the number of dish racks. The dishwasher may also include a bacteria sensor disposed in or adjunct to the tub or the sump, the bacteria sensor configured to monitor a level of bacteria in the fluid containing the rinse aid. The controller may be further configured to operate the first pump such that the fluid containing the rinse aid is drained from the sump if the level of bacteria is above a predetermined threshold.

The dishwasher may include a dedicated reservoir configured to retain the fluid containing the rinse aid from the initial wash cycle of the dishwasher and at least one dedicated nozzle configured to spray at least a portion of the fluid containing the rinse aid onto the number of dish racks before the start of the subsequent wash cycle of the dishwasher, in some embodiments. The dishwasher may further include a bacteria sensor disposed in or adjunct to the dedicated reservoir, the bacteria sensor configured to monitor a level of bacteria in the fluid containing the rinse aid. The fluid containing the rinse aid may be drained from the dedicated reservoir if the level of bacteria is above a predetermined threshold.

In some embodiments, the dishwasher may include a door sensor configured to monitor when a door of the dishwasher is opened and closed and to provide a door signal to the controller. The controller may be further configured to operate the pump such that the fluid containing the rinse aid is applied to the number of dish racks a predetermined time after the door signal indicates that the door has been opened and closed. The dishwasher may also include an electrochemical sensor configured to monitor an odor in the dishwasher and to provide an odor signal to the controller. The controller may be further configured to operate the pump such that the fluid containing the rinse aid is applied to the number of dish racks when the odor signal indicates that the odor in the dishwasher has reached a predetermined threshold.

BRIEF DESCRIPTION OF THE DRAWINGS

The detailed description particularly refers to the following figures, in which.

DETAILED DESCRIPTION OF THE DRAWINGS

Figure 1:
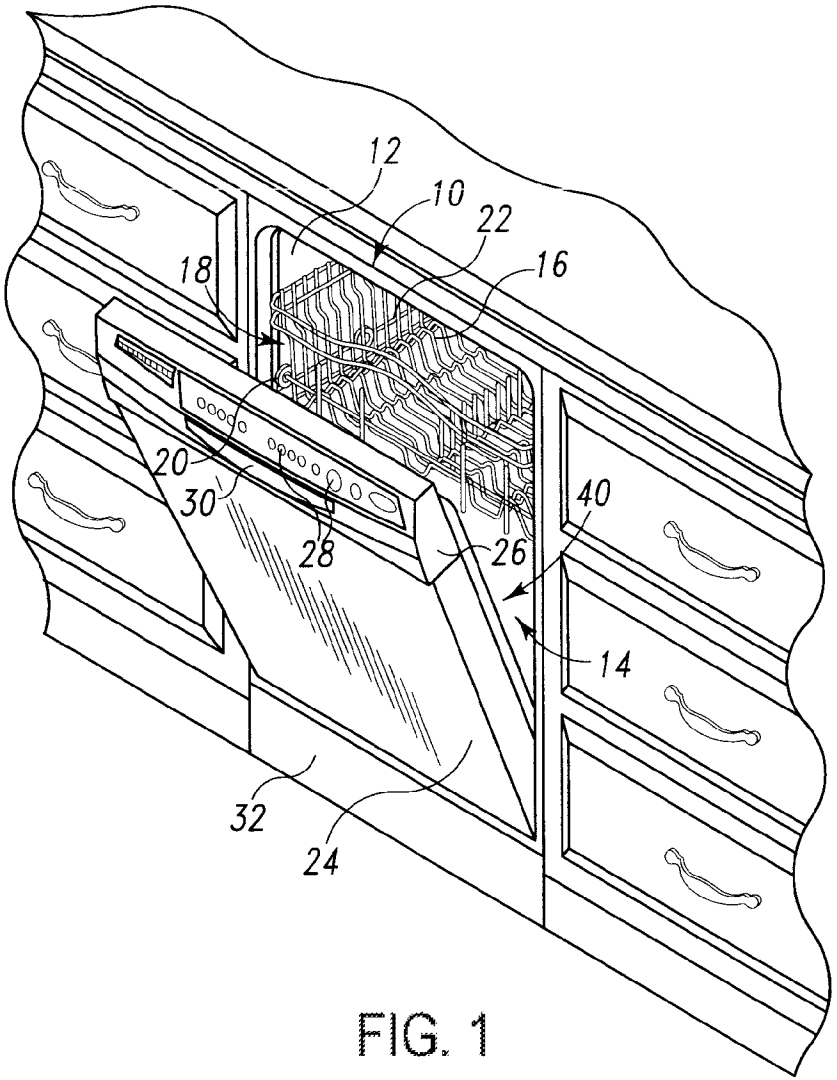
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The present disclosure relates to a method of preconditioning soils on wares between successive wash cycles of a dishwasher by retaining a fluid containing a rinse aid from an initial wash cycle and applying at least a portion of the retained fluid containing the rinse aid to soils on wares in the dishwasher before the start of a subsequent wash cycle. By use of the term "wash cycle," it is meant the operation of a dishwasher upon a set of soiled wares which produces a set of cleaned wares, starting with a user activation, then proceeding continuously without the need for user intervention, and including at least one washing stage and at least one rinsing stage. A washing stage involves the application of a wash chemistry, typically water and detergent, to remove soils from the wares. A rinsing stage involves the application of a rinse chemistry, typically water and rinse aid, to remove the wash chemistry and prepare the wares for drying. A wash cycle may optionally include other stages, such as a drying stage in which heat is applied after the rinsing stage. A wash cycle may be interrupted by a user, such as by opening a door of the dishwasher, thereby causing the wash cycle to pause until the door is closed. However, without such user intervention, the wash cycle will proceed continuously.

At the completion of a wash cycle, a user will remove the set of cleaned wares, either immediately or after a period of time. The period between the wash cycles of the dishwasher thus begins when the user removes a set of cleaned wares from the dishwasher and ends when the user activates a subsequent wash cycle. During the period between wash cycles, a user will load the dishwasher with soiled wares, typically gradually as the wares are used. During this period, soils on the wares may lose moisture and create odor within the dishwasher.

Referring now to FIG. 1, there is shown a dishwasher 10 having a tub 12 which defines a washing chamber 14 into which wares, such as dishes and other cooking and eating wares (e.g., plates, bowls, glasses, flatware, pots, pans, bowls, etcetera) are placed to be washed. The dishwasher 10 includes a number of dish racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from, and retract back into, the tub 12. Such movement facilitates the loading and unloading of the dishwasher racks 16. The roller assemblies 18 include a number of rollers 20 which roll along the top of, and in some cases the top and bottom of, a corresponding support rail 22.

A door 24 is hinged to the lower front edge of the tub 12. User access to the dish racks 16 positioned in the washing chamber 14 is provided through an access opening 40. As such, when the door 24 is closed, user access to the dish racks 16 is prevented, whereas user access to the dish racks 16 is permitted when the door 24 is open. The door 24 also functions to seal the dishwasher 10 so that liquids do not escape the access opening 40 of the dishwasher 10 during a wash cycle.

A user control panel 26 is located at the top of the door 24. The user control panel 26 includes a number of controls 28, such as buttons and knobs. A user may manipulate the controls 28 to manage operations of the dishwasher 10, including activation of a wash cycle, selection of optional stages to be included in the wash cycle, or activation of other features of the dishwasher 10. A handle 30 is also included in the user control panel 26. The handle 30 is operable by a user to unlatch the door 24 so that it may be opened by the user.

A machine compartment 32 is located below the tub 12. The machine compartment 32 is sealed from the tub 12. In other words, unlike the tub 12, the machine compartment 32 does not fill with water during operation of the dishwasher 10. The machine compartment 32 houses components such as the dishwasher's water pump(s) and valve(s), along with the associated wiring and plumbing. It should be noted that, although FIG. 1 depicts a dishwasher 10 installed in a kitchen cabinet, portable dishwashers, which may be removably connected to a faucet, are also contemplated.

Figure 2:
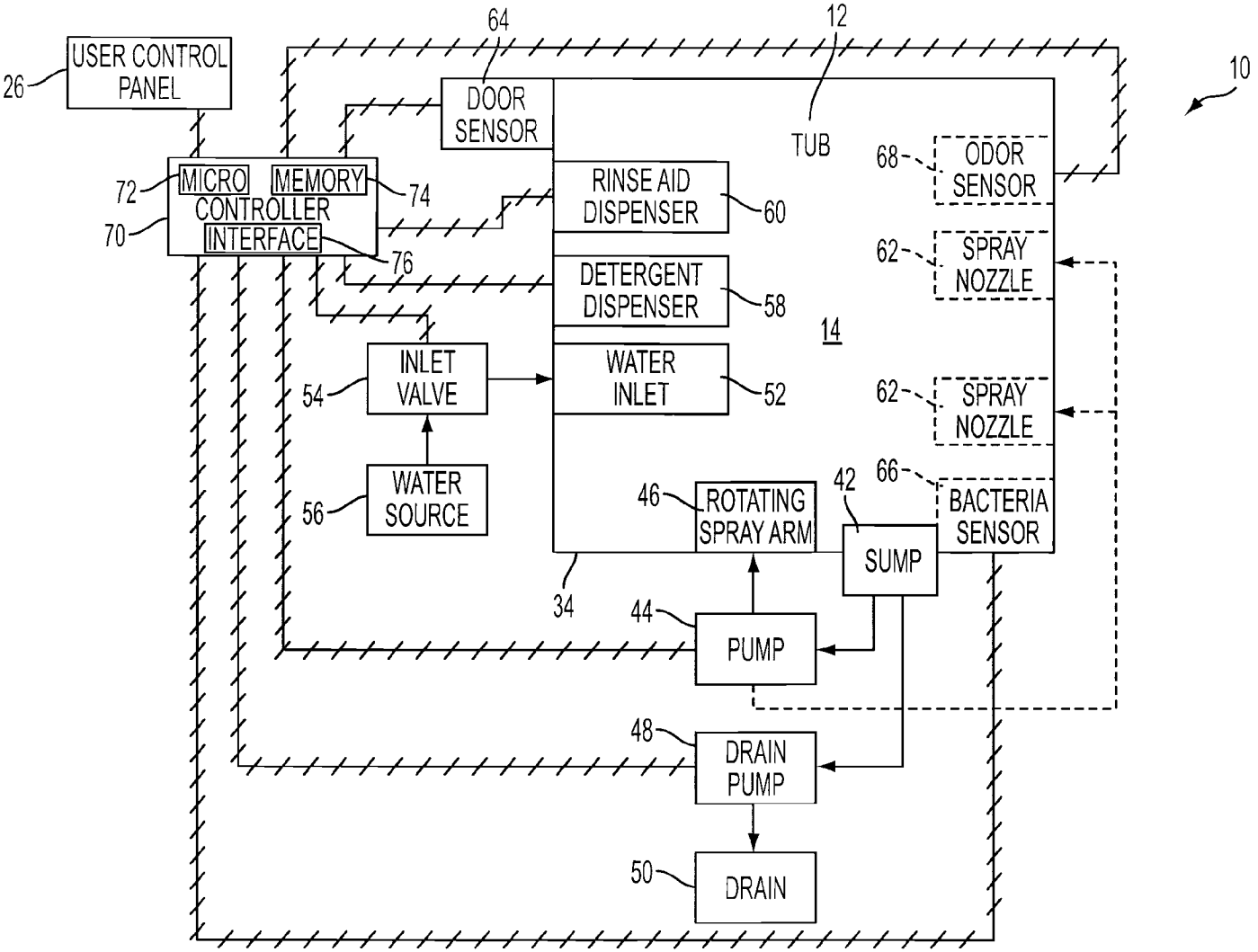
FIG. 2 is a simplified block diagram of one illustrative embodiment of a control system of a dishwasher.

Referring now to FIG. 2, some of the components of the dishwasher 10, according to one illustrative embodiment, are shown in a simplified block diagram. As discussed above, the dishwasher 10 includes a tub 12 which defines a washing chamber 14. These components are labeled using the same reference numerals as FIG. 1, and similar components are labeled using similar reference numerals in all figures throughout this disclosure. In the simplified block diagrams of FIGS. 2 and 5, lines with cross-hatches indicate an electrical connection between two elements, such as wiring, while solid (or phantom) arrows indicate a fluid connection, such as pipes, hoses, or other plumbing.

A sidewall of the tub 12 includes a water inlet opening 52. The water inlet opening 52 directs water received from an external water source 56 (e.g., house water supply, kitchen faucet, etcetera) into the washing chamber 14. A water inlet valve 54 positioned between the external water source 56 and the water inlet opening 52 may be selectively opened or closed to control the flow of water through the water inlet opening 52. In some embodiments, the water inlet valve 54 may be an electromechanical valve, such as a solenoid-controlled valve, which opens and closes in response to a control signal.

The dishwasher 10 includes a detergent dispenser 58 which operates to introduce a detergent, typically in either powder, gel, or tablet form, into the washing chamber 14. The introduced detergent mixes with water in the washing chamber 14 to form a wash chemistry which is applied to aid in the removal of soils from wares during a washing stage of a wash cycle. The detergent dispenser 58 may be located on the surface of the door 24 which faces the washing chamber 14, such that a user may easily refill the detergent dispenser 58 with detergent when the door 24 is opened between wash cycles. In some embodiments, the detergent dispenser 58 may include an electromechanical valve, such as a solenoid-controlled valve, which opens and/or closes in response to a control signal.

A rinse aid dispenser 60 which operates to introduce a rinse aid, typically in either liquid or gel form, into the washing chamber 14 is also included in dishwasher 10. A "rinse aid" includes either a surface acting agent (also known as a surfactant), one or more sanitizing chemicals (such as bleach, for example), or both, and may contain other chemistries. A rinse aid may be a single mixture or may be stored as two or more separate components until introduction into the washing chamber 14. By way of illustrative example, a rinse aid might contain about 66.67% surfactant by volume and about 33.33% bleach by volume. It should be appreciated that embodiments in which the rinse aid includes a surfactant or a sanitizing chemical, but not both, are also contemplated.

Upon introduction, the rinse aid mixes with water in the washing chamber 14 to form a rinse chemistry which may assist in rinsing the wash chemistry from the wares during a rinsing stage and also in drying and sanitizing the wares during a drying stage of a wash cycle. The rinse aid dispenser 60 may be located on the surface of the door 24 which faces the washing chamber 14, such that a user may easily refill the rinse aid dispenser 60 with rinse aid when the door 24 is opened between wash cycles. In some embodiments, the rinse aid dispenser 60 may include an electromechanical valve, such as a solenoid-controlled valve, which opens and/or closes in response to a control signal.

The dishwasher 10 further includes a sump 42 which is formed (e.g., stamped) into a bottom wall 34 of the tub 12. In particular, the sump 42 defines a reservoir which extends downwardly in a direction away from the washing chamber 14. The bottom wall 34 of the tub 12 has a sloped configuration which directs the wash chemistry or the rinse chemistry into the sump 42. The sump 42 is connected to an external drain 50 (e.g., house sewer line, kitchen sink, etcetera). A drain pump 48 is positioned between the sump 42 and the external drain 50. A control signal may selectively energize the drain pump 48 to drain liquids from the sump 42 or de-energize (turn off) the drain pump 48 to retain liquids in the sump 42. In other embodiments, an electromechanical valve, such as a solenoid-controlled valve, which opens and closes in response to a control signal may be used in place of drain pump 48.

When the drain pump 48 remains de-energized (turned off), a re-circulation pump 44 located in the mechanical compartment 32 is operable to re-circulate any retained liquids from the sump 42 onto the dish racks 16 (not shown in FIG. 2). The output from the re-circulation pump 44 is connected to a rotating spray arm 46 which sprays the wash chemistry or rinse chemistry onto the dish racks 16 (and hence the wares being washed). Re-circulation pump 44 may be driven by an electric motor which is energized in response to a control signal. Optionally, the re-circulation pump 44 may also be connected to one or more spray nozzles 62 designed to target particular zones of the washing chamber 14 or to spray one or more dish racks 16 in a particular manner (e.g., high-pressure spray, low-pressure mist, etcetera). In other embodiments, a single pump which is operable in multiple directions may be used in place of both re-circulation pump 44 and drain pump 48.

The dishwasher 10 may also include a variety of sensors which monitor conditions within the washing chamber 14, the sump 42, and/or other components of the dishwasher 10. For example, the dishwasher 10 has a door sensor 64 which monitors a state of the door 24 and outputs a door signal indicative of whether the door 24 is open or closed. This door signal may be used by the dishwasher 10 to pause a wash cycle when a user unlatches and opens the door 24. In some embodiments, the door sensor 64 may be an electromechanical, binary-type switch.

A bacteria sensor 66 may optionally be disposed in or adjunct to the tub 12 or the sump 42 to monitor a level of bacteria in a liquid retained when the drain pump 48 is de-energized. In one illustrative embodiment, the bacteria sensor 66 may be an electrochemical sensor, the electrical properties of which change in the presence one or more types of bacteria (e.g., a conductometric, potentiometric, gravimetric, or optical chemosensor; a calorimetric or amperometric sensor; a chemocapacitor; etcetera). The bacteria sensor 66 may output a bacteria signal indicative of the level of bacteria in the washing chamber 14 generally, or indicative of the level of certain types of bacteria.

The dishwasher may also optionally include an odor sensor 68 disposed in the washing chamber 14 to detect the presence or level of an odor therein. In one illustrative embodiment, the odor sensor 68 may be an electrochemical sensor, the electrical properties of which change in the presence one or more chemicals associated with an odor or odors (e.g., a conductometric, potentiometric, gravimetric, or optical chemosensor; a calorimetric or amperometric sensor; a chemocapacitor; etcetera). The odor sensor 68 may output an odor signal indicative of the presence or level of an odor in the washing chamber 14.

The dishwasher 10 also includes an electronic control unit (ECU) or "electronic controller" 70. The electronic controller 70 may be positioned in either the door 24 or the machine compartment 32 of the dishwasher 10. The electronic controller 70 is, in essence, the master computer responsible for interpreting electrical signals sent by sensors associated with the dishwasher 10 and for activating or energizing electronically-controlled components associated with the dishwasher 10. For example, the electronic controller 70 is configured to control operation of the water inlet valve 54, the detergent dispenser 58, the rinse aid dispenser 60, the drain pump 48, and the re-circulation pump 44, to monitor various signals from the user control panel 26, the door sensor 64, the bacteria sensor 66, and the odor sensor 68, and to determine when various operations of the dishwasher 10 should be performed, amongst many other things. In particular, as will be described in more detail below with reference to FIGS. 3 and 4A-4D, the electronic controller 70 is operable to control the components of the dishwasher 10 such that a fluid containing a rinse aid is retained from an initial wash cycle of the dishwasher and at least a portion of the fluid containing the rinse aid is applied to the number of dish racks 16 before the start of a subsequent wash cycle of the dishwasher.

To do so, the electronic controller 70 includes a number of electronic components commonly associated with electronic units utilized in the control of electromechanical systems. For example, the electronic controller 70 may include, amongst other components customarily included in such devices, a processor such as a microprocessor 72 and a memory device 74 such as a programmable read-only memory device ("PROM") including erasable PROM's (EPROM's or EEPROM's). The memory device 74 is provided to store, amongst other things, instructions in the form of, for example, a software routine (or routines) which, when executed by the microprocessor 72, allows the electronic controller 70 to control operation of the dishwasher 10.

The electronic controller 70 also includes an analog interface circuit 76. The analog interface circuit 76 converts the output signals from various sensors (e.g., the bacteria sensor 66) into signals which are suitable for presentation to an input of the microprocessor 72. In particular, the analog interface circuit 76, by use of an analog-to-digital (A/D) converter (not shown) or the like, converts the analog signals generated by the sensors into digital signals for use by the microprocessor 72. It should be appreciated that the A/D converter may be embodied as a discrete device or number of devices, or may be integrated into the microprocessor 72. It should also be appreciated that if any one or more of the sensors associated with the dishwasher 10 generate a digital output signal, the analog interface circuit 76 may be bypassed.

Similarly, the analog interface circuit 76 converts signals from the microprocessor 72 into output signals which are suitable for presentation to the electrically-controlled components associated with the dishwasher 10 (e.g., the re-circulation pump 44). In particular, the analog interface circuit 76, by use of a digital-to-analog (D/A) converter (not shown) or the like, converts the digital signals generated by the microprocessor 72 into analog signals for use by the electronically-controlled components associated with the dishwasher 10. It should be appreciated that, similar to the A/D converter described above, the D/A converter may be embodied as a discrete device or number of devices, or may be integrated into the microprocessor 72. It should also be appreciated that if any one or more of the electronically-controlled components associated with the dishwasher 10 operate on a digital input signal, the analog interface circuit 76 may be bypassed.

Thus, the electronic controller 70 may control operation of the re-circulation pump 44 and the drain pump 48. In particular, the electronic controller 70 executes a routine including, amongst other things, a control scheme in which the electronic controller 70 monitors outputs of the sensors associated with the dishwasher 10 to control the inputs to the electronically-controlled components associated therewith. To do so, the electronic controller 70 communicates with the sensors associated with the dishwasher 10 to determine, amongst numerous other things, the state of the door 24, the level of bacteria in the washing chamber 14, and/or the presence of an odor in the washing chamber 14. Armed with this data, the electronic controller 70 performs numerous calculations, either continuously or intermittently, including looking up values in preprogrammed tables, in order to execute algorithms to perform such functions as controlling the drain pump 48 to retain a fluid containing a rinse aid in the sump 42, determining when application of the retained fluid containing the rinse aid is needed, controlling the re-circulation pump 44 to apply the fluid containing the rinse aid to soils on wares in the dishwasher 10, etcetera.

As will be appreciated by those of the skill in the art, the dishwasher 10 may include elements other than those shown and described above, such as, by way of example, an electric heating element to assist in drying the wares or a filter to remove particulates from the re-circulated wash chemistry or rinse chemistry. It should also be appreciated that the location of many components (i.e., in the washing chamber 14, in the machine compartment 32, in or on the door 24) may also be altered.

Figure 3:
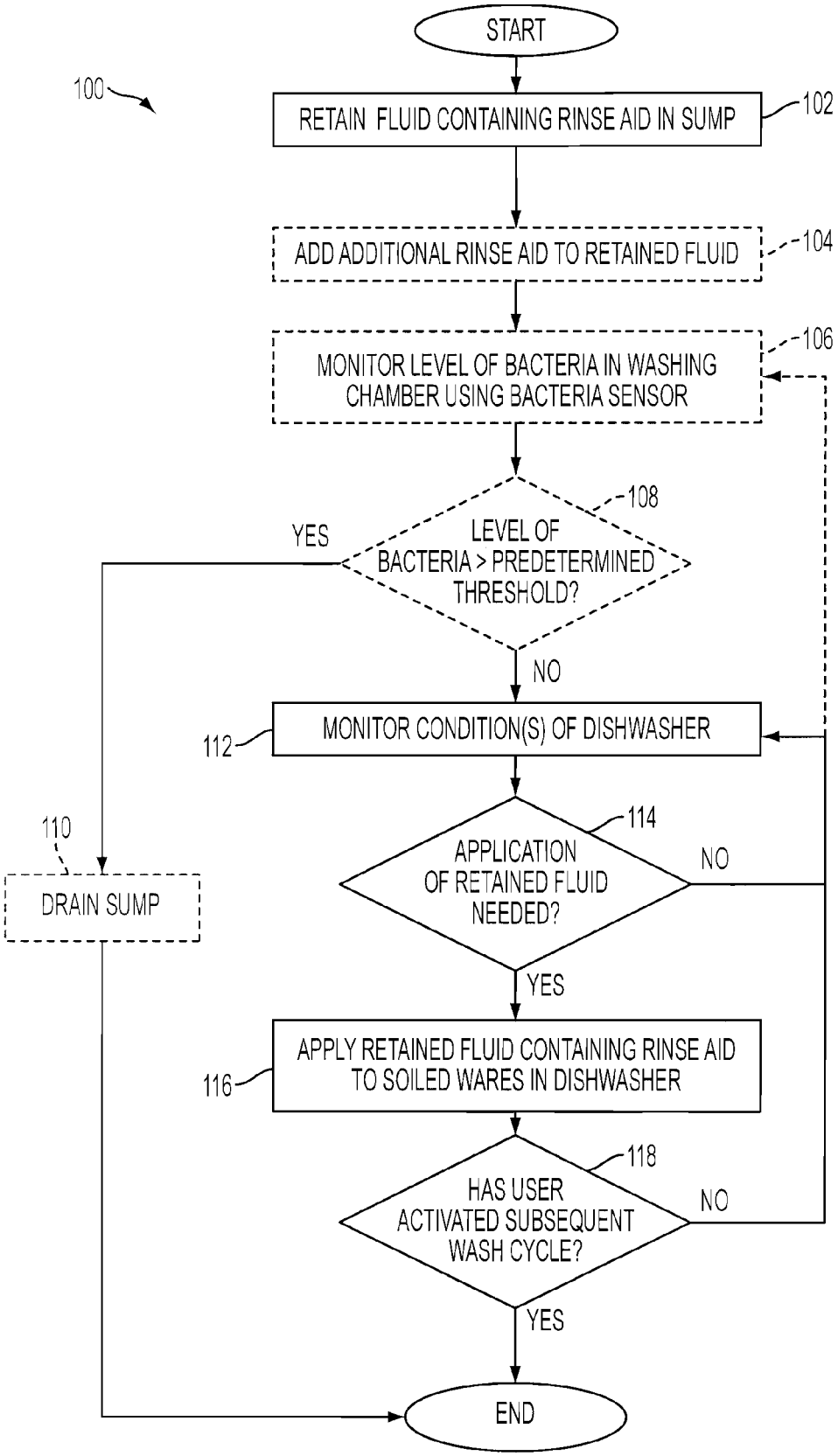
FIG. 3 is a simplified flowchart of a method of operating the dishwasher of FIG. 2.

Referring now to FIG. 3, an illustrative embodiment of a method of operating the dishwasher of FIG. 2 is illustrated as a simplified flow diagram. The operating process 100 may be used to precondition soils on wares placed in dishwasher 10 between successive wash cycles of the dishwasher 10. The operating process 100 includes a number of process steps 102-118, as shown in FIG. 3. Process step 104 and process steps 106-110 may be optionally employed in the operating process 100 and are, therefore, indicated in phantom in FIG. 3.

The operating process 100 begins with process step 102, in which a fluid containing a rinse aid is retained in the sump 42 from an initial wash cycle of the dishwasher 10. As described above, a wash cycle of the dishwasher 10 includes a rinsing stage in which a rinse chemistry, containing water and a rinse aid, is applied to the dish racks 16. During process step 102, the electronic controller 70 operates the drain pump 48 via a control signal to de-energize the drain pump 48 before all of the rinse chemistry is drained from the sump 42 into the external drain 50. Thus, at least some (if not all) of the rinse chemistry used in the rinsing stage of the initial wash cycle is retained in the sump 42 of the dishwasher 10 beyond the conclusion of the initial wash cycle.

After process step 102, the operating process 100 optionally proceeds to process step 104, in which an additional quantity of rinse aid may be added to the fluid, if necessary. Process step 104 may be used when it is desired that the concentration of rinse aid in the fluid be increased. By way of illustrative example, for purposes of operating method 100 it may be desired that the fluid containing the rinse aid comprise approximately 1.33 milliliters of surfactant, 0.67 milliliters of bleach, and 1.5 gallons of water. If the amount of rinse aid is lower than this amount, the electronic controller 70 may operate the rinse aid dispenser 60 to introduce an additional quantity of rinse aid into the washing chamber 14.

After process step 104 (or process step 102, if optional process step 104 is unneeded or not employed), the operating process 100 may proceed to optional process steps 106-110, if the dishwasher 10 includes the optional bacteria sensor 66 disposed in the sump 42. If not, the operating process 100 proceeds to process step 112. In optional process steps 106-110, the dishwasher 10 monitors a level of bacteria in the washing chamber 14 to ensure that the retained fluid containing the rinse aid is not applied to the wares if it contains an undesired level of bacteria.

Specifically, in process step 106, the electronic controller 70 receives a bacteria signal indicating the level of bacteria in the sump 42 from the bacteria sensor 66. In process step 108, the electronic controller 70 compares the value of the bacteria signal to a predetermined threshold which corresponds to the maximum acceptable level of bacteria. If the bacteria signal is greater than the predetermined threshold, the operating process 100 may proceed to process step 110, in which the electronic controller 70 energizes the drain pump 48 to drain the sump 42, after which the operating process 100 ends. Alternatively, in embodiments in which the rinse aid includes one or more sanitizing chemicals, the electronic controller 70 may operate the rinse aid dispenser 60 to introduce an additional quantity of rinse aid into the washing chamber 14, as discussed in process step 102. If the bacteria signal is not greater than the predetermined threshold, the operating process 100 continues to process step 112.

After optional process step 108 (or either process steps 102 or 104, if the optional process steps are unneeded or not employed), the operating process 100 proceeds to process steps 112 and 114, in which the electronic controller 70 monitors one or more conditions of the dishwasher 10. Process step 112 may include the electronic controller 70 receiving signals from one or more sensors, including the door sensor 64, the odor sensor 68, and the user control panel 26, as well as referencing an internal clock signal of the microprocessor 72.

In process step 114, the electronic controller 70 determines whether an application of the retained fluid containing the rinse aid is needed based upon the data received in process step 112, such as by comparing the sensor signals to various thresholds or by using look-up tables or algorithms. If the electronic controller 70 determines that an application is unneeded, the operating process 100 returns to process step 112 (or to process step 106 if the dishwasher 10 includes the optional bacteria sensor 66). If the electronic controller 70 determines that an application of the retained fluid is needed, the operating process 100 continues to process step 116. Process steps 112 and 114 may be embodied as one or more sub-processes running sequentially or simultaneously. These various sub-processes will be described in greater detail below with reference to FIGS. 4A-4D.

In process step 116, the electronic controller 70 operates the re-circulation pump 44 via a control signal to apply at least a portion of the fluid containing the rinse aid to soils on wares in the dishwasher. The re-circulation pump 44 may re-circulate the fluid containing the rinse aid through the rotating spray arm 46 onto the dish racks 16 (and hence the wares). Alternatively or additionally, the re-circulation pump 44 may re-circulate the fluid containing the rinse aid through one or more spray nozzles 62 onto one or more dish racks 16. In some embodiments, the spray nozzles 62 may be dedicated spray nozzles used only for this purpose.

After process step 116, the operating process 100 proceeds to process step 118, in which the electronic controller 70 determines whether the user has activated a subsequent wash cycle of the dishwasher 10. In process step 118, the electronic controller 70 monitors one of the controls 28 on the user control panel 26 which corresponds to activation of new wash cycle. If a user has activated a subsequent wash cycle, operating process 100 ends. If the user has not activated a subsequent wash cycle, the operating process 100 returns to process step 112 (or to process step 106 if the dishwasher 10 includes the optional bacteria sensor 66). Process step 118 may also be embodied as an "interrupt," in which the electronic controller 70 constantly monitors the user control panel 26 and wherein user activation of a new wash cycle will end the operating process 100 regardless of its current state.

Figure 4A:
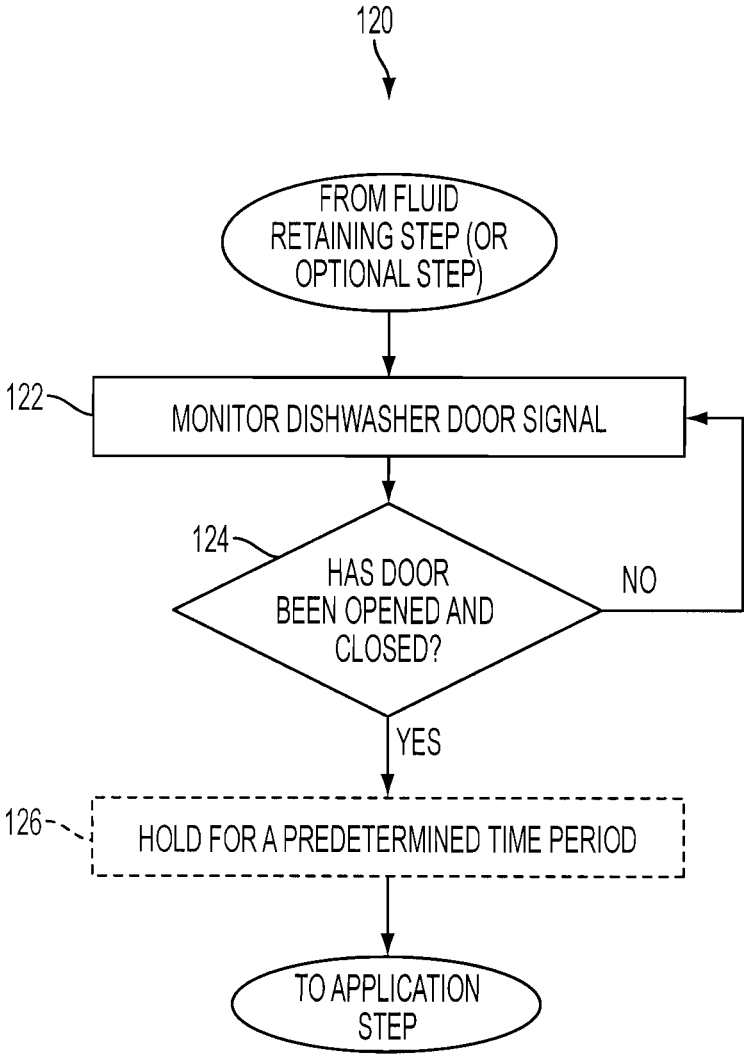
FIG. 4A is a simplified flowchart of one illustrative method of monitoring a condition of a dishwasher to determine when application of a fluid containing a rinse aid is needed.

One illustrative embodiment of process steps 112, 114 of the operating process 100 is shown in detail in FIG. 4A as a door monitoring sub-process 120 consisting of process steps 122-126. During door monitoring sub-process 120, the electronic controller 70 monitors the opening and closing of the door 24 of the dishwasher 10 to determine whether an application of the retained fluid containing the rinse aid is needed. The opening and closing of the door 24 during the period between wash cycles typically corresponds to a user loading soiled wares into the dish racks 16, and the retained fluid containing the rinse aid may be applied to precondition the soils on these wares.

The door monitoring sub-process 120 begins with process step 122, in which the electronic controller 70 receives a door signal indicating the state of the door 24 from the door sensor 64. In process step 124, the electronic controller 70 monitors the door signal to determine if the door 24 has been opened and closed. If the door has not been opened and closed, the door monitoring sub-process 120 returns to process step 122. If the door has been opened and closed, the door monitoring sub-process 120 proceeds, either to the optional process step 126 or to process step 116 of the operating process 100. Optional process step 126 may involve the door-monitoring sub-process 120 holding for a number of seconds, minutes, or hours, before proceeding to process step 116. As discussed above, in process step 116 of the operating process 100, the electronic controller 70 operates the re-circulation pump 44 via a control signal to apply at least a portion of the fluid containing the rinse aid to soils on wares in the dishwasher.

Figure 4B:
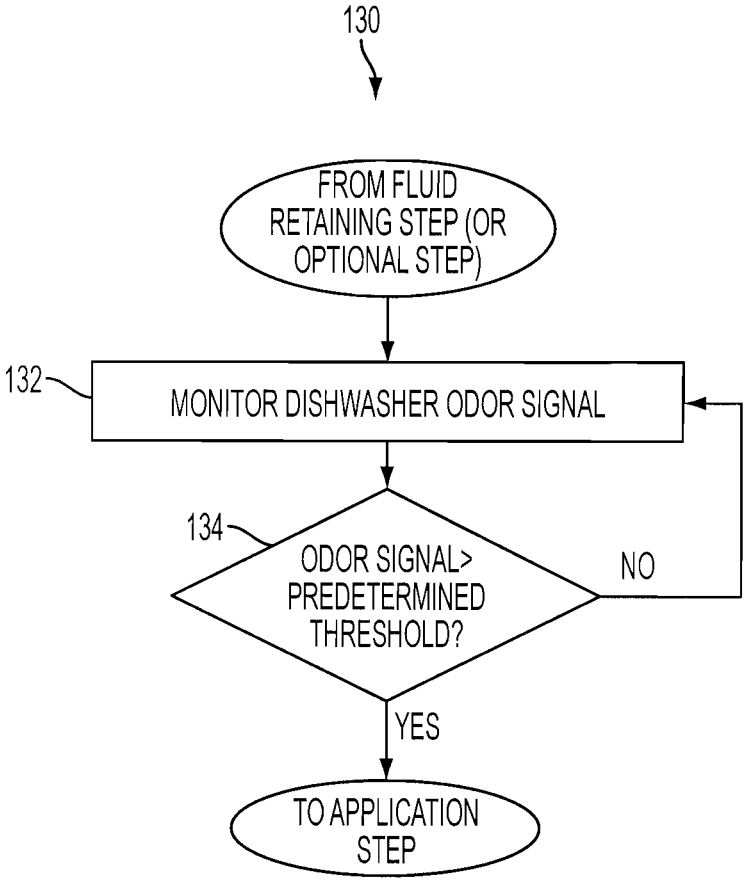
FIG. 4B is a simplified flowchart of another illustrative method of monitoring a condition of a dishwasher to determine when application of a fluid containing a rinse aid is needed.

Another illustrative embodiment of process steps 112, 114 of the operating process 100 is shown in detail in FIG. 4B as an odor monitoring sub-process 130 consisting of process steps 132 and 134. During odor monitoring sub-process 130, the electronic controller 70 monitors the washing chamber 14 for any odors to determine whether an application of the retained fluid containing the rinse aid is needed. Odors in the washing chamber 14 typically correspond to the presence of soiled wares in the dish racks 16, and the retained fluid containing the rinse aid may be applied to precondition the soils on these wares.

The odor monitoring sub-process 130 begins with process step 132, in which the electronic controller 70 receives a odor signal indicating presence, absence, or level of an odor from the odor sensor 68. In process step 134, the electronic controller 70 compares the value of the odor signal to a predetermined threshold which corresponds to the maximum acceptable odor level. If the odor signal is not greater than the predetermined threshold, the odor monitoring sub-process 130 returns to process step 132. If the odor signal is greater than the predetermined threshold, the odor monitoring sub-process 130 proceeds to process step 116 of the operating process 100. As discussed above, in process step 116, the electronic controller 70 operates the re-circulation pump 44 via a control signal to apply at least a portion of the fluid containing the rinse aid to soils on wares in the dishwasher.

Figure 4C:
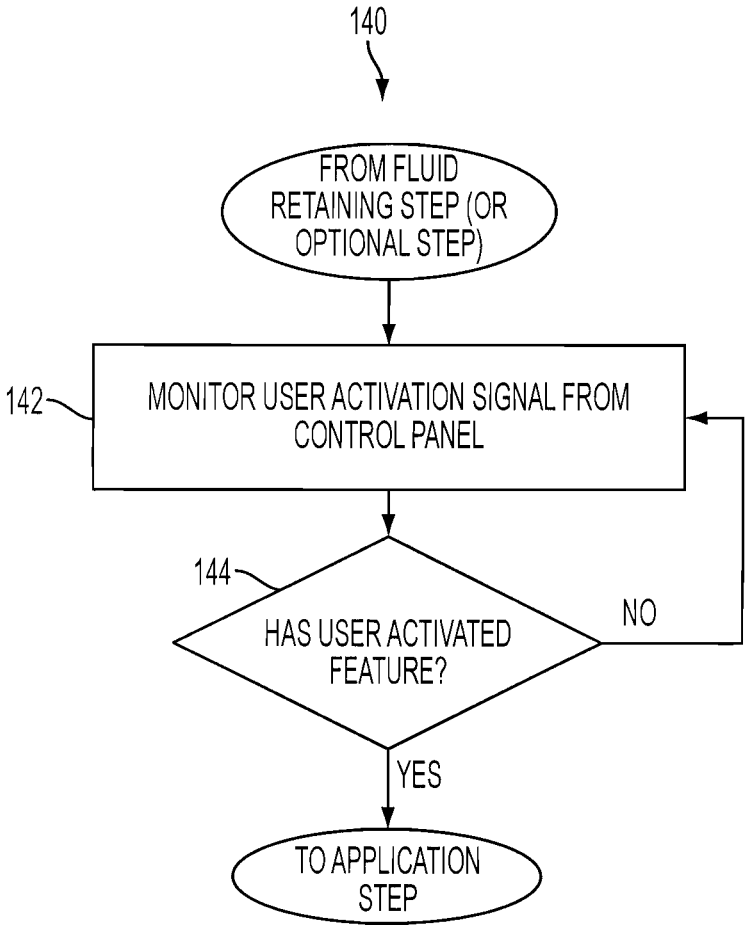
FIG. 4C is a simplified flowchart of another illustrative method of monitoring a condition of a dishwasher to determine when application of a fluid containing a rinse aid is needed.

Another illustrative embodiment of process steps 112, 114 of the operating process 100 is shown in detail in FIG. 4C as an activation monitoring sub-process 140 consisting of process steps 142 and 144. During activation monitoring sub-process 140, the electronic controller 70 monitors one or more of the controls 28 on the user control panel 26 which correspond to user activation of a "Water Conserving Feature," a "Tough Soil Feature," or an "Odor Management" feature, by way of example. Activation of such a control 28 on the control panel corresponds to a user request that the retained fluid containing the rinse aid be applied to precondition the soils on wares placed in the dishwasher 10.

The activation monitoring sub-process 140 begins with process step 142, in which the electronic controller 70 monitors the user control panel 26 for an activation signal from an appropriate control 28. In process step 144, the electronic controller 70 determines whether the activation signal has been transmitted from the user control panel 26. If the activation signal has not been transmitted, the activation monitoring sub-process 140 returns to process step 142. If the activation signal has been transmitted, the activation monitoring sub-process 140 proceeds to process step 116 of the operating process 100. As discussed above, in process step 116, the electronic controller 70 operates the re-circulation pump 44 via a control signal to apply at least a portion of the fluid containing the rinse aid to soils on wares in the dishwasher.

Figure 4D:
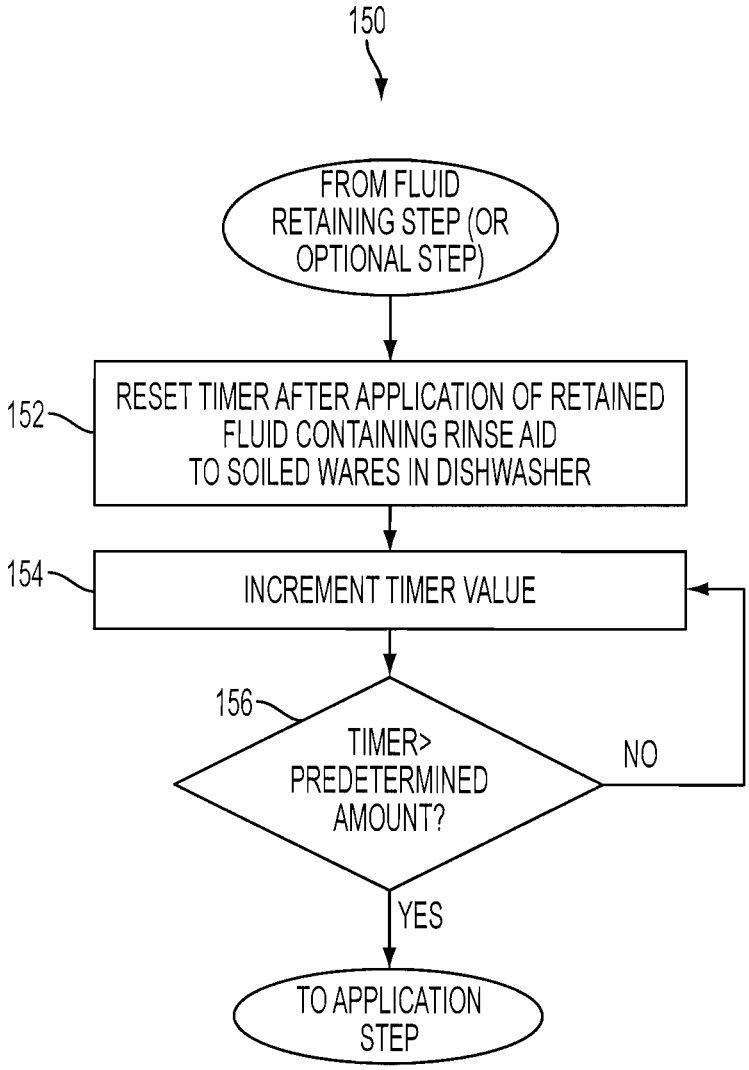
FIG. 4D is a simplified flowchart of another illustrative method of monitoring a condition of a dishwasher to determine when application of a fluid containing a rinse aid is needed.

Another illustrative embodiment of process steps 112, 114 of the operating process 100 is shown in detail in FIG. 4D as a timer monitoring sub-process 150 consisting of process steps 152-156. During timer monitoring sub-process 150, the electronic controller 70 monitors a timer value representative of the time elapsed since a prior application of the retained fluid containing the rinse aid to determine whether an application of the retained fluid containing the rinse aid is needed. After a predetermined amount of time, typically on the order of hours or days, a subsequent application of the retained fluid may be desired.

The timer monitoring sub-process 150 begins with process step 152, in which the electronic controller 70 resets an timer value to zero whenever the retained fluid containing the rinse aid is applied to soiled wares in the dishwasher 10. In some embodiments, process step 152 may also involve resetting the timer value to zero at the conclusion of the initial wash cycle of the dishwasher 10. In process step 154, the electronic controller 70 increments the timer value by one unit. In process step 156, the electronic controller 70 compares the timer value to a predetermined amount of time which corresponds to the maximum acceptable time between applications. If the timer value is not greater than the predetermined amount of time, the timer monitoring sub-process 150 returns to process step 154. If the timer value is greater than the predetermined amount of time, the timer monitoring sub-process 150 proceeds to process step 116 of the operating process 100. As discussed above, in process step 116, the electronic controller 70 operates the re-circulation pump 44 via a control signal to apply at least a portion of the fluid containing the rinse aid to soils on wares in the dishwasher.

One or more of these embodiments of process steps 112 and 114 of the operating process 100 (illustrated in FIGS. 4A-4D) may be executed by the electronic controller 70 sequentially or simultaneously. In other words, the operating process 100 may employ any or all of the door monitoring, odor monitoring, activation monitoring, or timer monitoring sub-processes 120, 130, 140, 150. By way of illustrative example, the electronic controller 70 may simultaneously monitor signals from the door sensor 64, the odor sensor 68, and the user control panel 26, while incrementing the timer value, and initiate an application of the fluid containing the rinse aid if any of the conditions described above are met.

Figure 5:
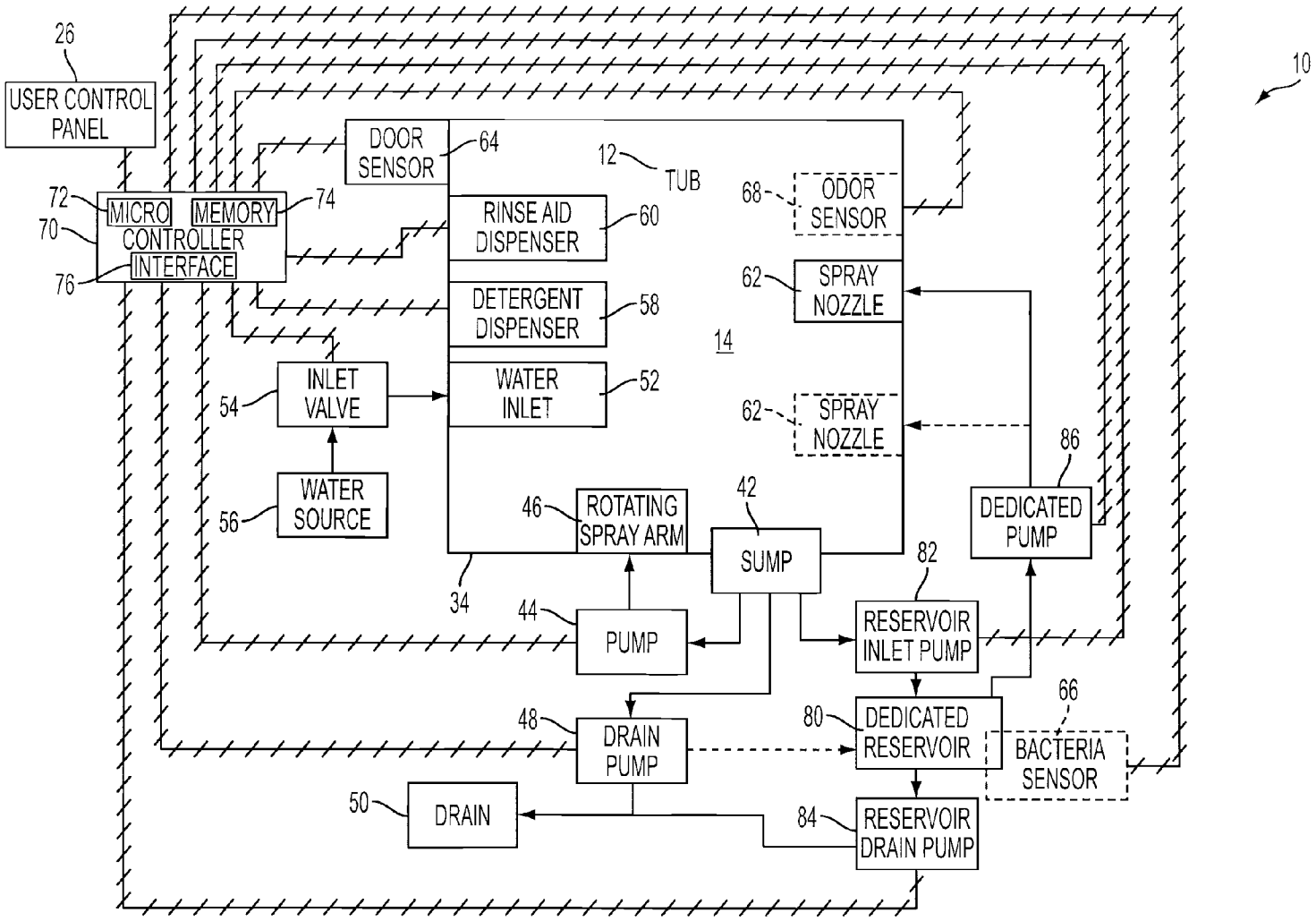
FIG. 5 is a simplified block diagram of another illustrative embodiment of a control system of a dishwasher.

Referring now to FIG. 5, some of the components of another illustrative embodiment of dishwasher 10 are shown in a simplified block diagram. The dishwasher of FIG. 5 shares many similar components with the dishwasher of FIGS. 1 and 2, and these similar components are labeled using common reference numerals for clarity. Furthermore, many of these similar components operate in a substantially similar manner to the operation described with reference to FIG. 2. Thus, only the additional components and alterations to the similar components illustrated in FIG. 5 will be described below.

The illustrative embodiment of dishwasher 10 shown in FIG. 5 further includes a dedicated reservoir 80 which is configured to retain a fluid containing a rinse aid from an initial wash cycle of the dishwasher 10. The dedicated reservoir 80 may be located in the machine compartment 32. The dedicated reservoir 80 is in fluid communication with the sump 42, such that liquids collected in the sump 42, particularly a rinse chemistry, may be selectively transferred to the dedicated reservoir 80. In some embodiments, a reservoir inlet pump 82 positioned between the sump 42 and the dedicated reservoir 80 may be selectively energized or de-energized using a control signal to control the flow of liquids into the dedicated reservoir 80. In other embodiments, an electromechanical valve, such as a solenoid-controlled valve, which opens and closes in response to a control signal may be used in place of reservoir inlet pump 82. In still other embodiments, the dedicated reservoir 80 may be in fluid communication with the sump 42 via the drain pump 48. In such embodiments, the drain pump 48 may be operable in multiple directions such that liquids may selectively transferred from the sump 42 to either the dedicated reservoir 80 or the external drain 50.

The dishwasher 10 also includes a reservoir drain pump 84 positioned between the dedicated reservoir 80 and the external drain 50. A control signal may selectively energize the reservoir drain pump 84 to drain a fluid containing a rinse aid from the dedicated reservoir 80 or de-energize the reservoir drain pump 84 to retain the fluid containing the rinse aid in the dedicated reservoir 80. In other embodiments, an electromechanical valve, such as a solenoid-controlled valve, which opens and closes in response to a control signal may be used in place of reservoir drain pump 84. When the reservoir drain pump 84 remains de-energized (turned off), a dedicated pump 86 is operable to re-circulate at least a portion of the retained fluid containing the rinse aid from the dedicated reservoir 80 through at least one dedicated spray nozzle 62 onto the dish racks 16 (and hence the wares placed in the dishwasher 10). In some embodiments, the re-circulation pump 44 may also be operable to re-circulate at least a portion of the retained fluid containing the rinse aid from the dedicated reservoir 80 through the rotating spray arm 46. It is also contemplated that more than one rotating spray arm and/or more than one spray nozzle may be used, either separately or in combination.

In the illustrative embodiment of dishwasher 10 shown in FIG. 5, the optional bacteria sensor 66 may be disposed in or adjunct to the dedicated reservoir 80, rather than in or adjunct to the tub 12 or the sump 42. The bacteria sensor 66 may be used to monitor a level of bacteria in a liquid retained in the dedicated reservoir 80. In some embodiments, the bacteria sensor 66 may be an electrochemical sensor (similar to that described with reference to FIG. 1) which outputs a bacteria signal indicative of the level of bacteria in the dedicated reservoir 80 generally, or indicative of the level of certain types of bacteria.

The electronic control unit (ECU) or "electronic controller" 70 of the dishwasher 10 shown in FIG. 5 may contain the same or similar components and may perform some or all of the same functions described with respect to FIG. 2. The electronic controller 70 of FIG. 5 also performs additional functions, such as controlling operation of the reservoir inlet pump 82, the reservoir drain pump 84, the dedicated pump 86, and any other optional components associated with the dedicated reservoir 80. As will be described in more detail below with reference to FIG. 6, the electronic controller 70 is operable to control the components of the dishwasher 10 such that a fluid containing a rinse aid is retained in the dedicated reservoir 80 from an initial wash cycle of the dishwasher and at least a portion of the fluid containing the rinse aid is sprayed through at least one dedicated nozzle 62 onto the number of dish racks before the start of a subsequent wash cycle of the dishwasher.

As will be appreciated by those of the skill in the art, the dishwasher 10 illustrated in FIG. 5 may include elements other than those shown and described above, such as, by way of example, an electric heating element to assist in drying the wares or a filter to remove particulates from the re-circulated wash chemistry or rinse chemistry. It should also be appreciated that the location of many components may also be altered.

Figure 6:
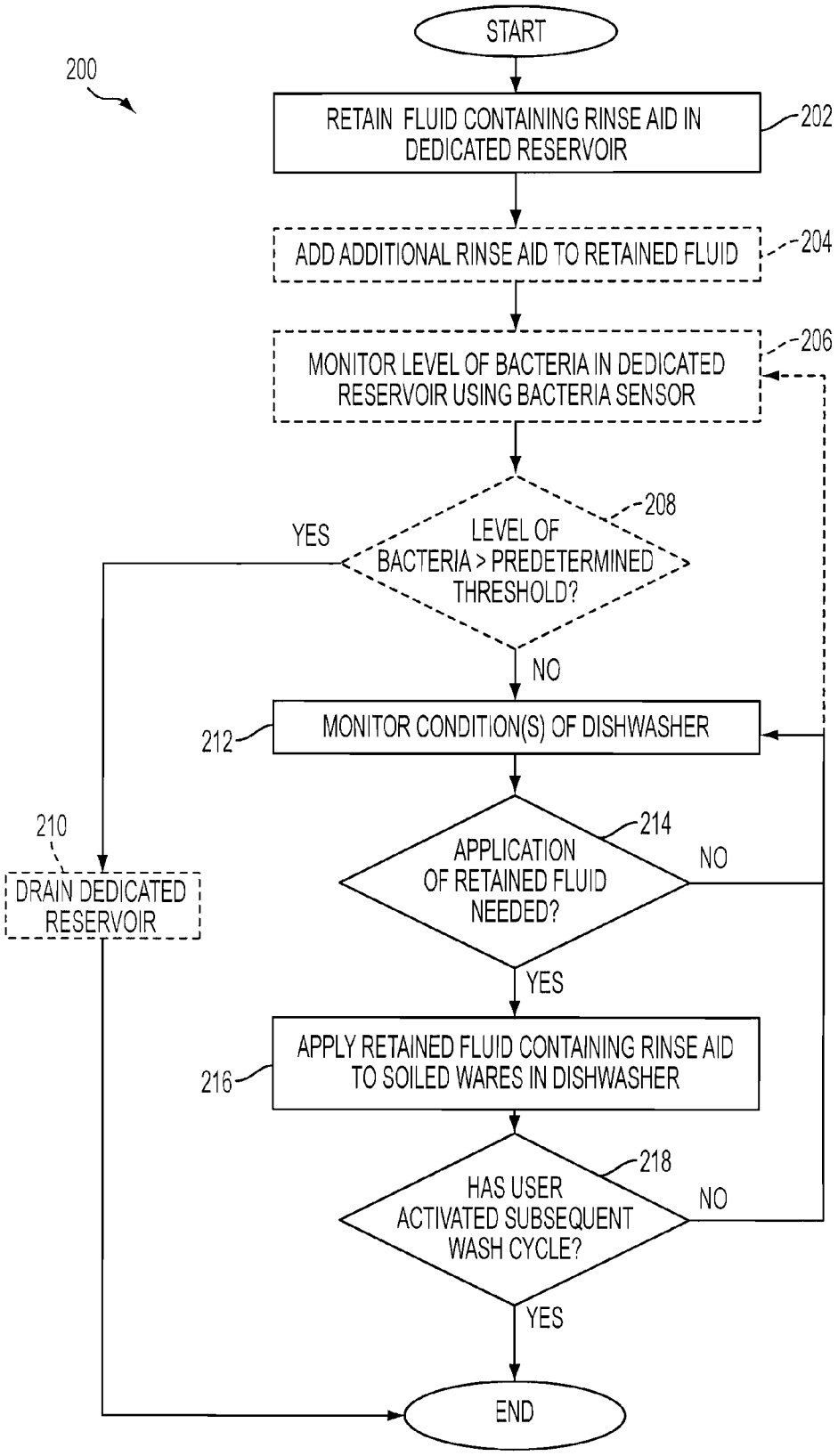
FIG. 6 is a simplified flowchart of a method of operating the dishwasher of FIG. 5.

Referring now to FIG. 6, an illustrative embodiment of a method of operating the dishwasher of FIG. 5 is illustrated as a simplified flow diagram. The operating process 200 may be used to precondition soils on wares placed in dishwasher 10 between successive wash cycles of the dishwasher 10. The operating process 200 includes a number of process steps 202-218, as shown in FIG. 6, some of which are similar to the process steps 102-118 of operating process 100, described above. Process step 204 and process steps 206-210 may be optionally employed in the operating process 200 and are, therefore, indicated in phantom in FIG. 6.

The operating process 200 begins with process step 202, in which a fluid containing a rinse aid is retained in the dedicated reservoir 80 from an initial wash cycle of the dishwasher 10. As described above, a wash cycle of the dishwasher 10 includes a rinsing stage in which a rinse chemistry, containing water and a rinse aid, is applied to the dish racks 16. During process step 202, the electronic controller 70, via a control signal, energizes the reservoir inlet pump 82 (or, in other embodiments, the drain pump 48) to direct at least some of the rinse chemistry into the dedicated reservoir 80 before the sump 42 is fully drained. The electronic controller 70 also de-energizes the reservoir drain pump 48, via a control signal, during process step 202. Thus, at least some (if not all) of the rinse chemistry used in the rinsing stage of the initial wash cycle is retained in the dedicated reservoir 80 of the dishwasher 10 beyond the conclusion of the initial wash cycle.

After process step 202, the operating process 200 may optionally proceed to either process step 204 or process step 206. Process step 204, in which an additional quantity of rinse aid may be added to the fluid, is substantially similar to process step 104 describe above. Process steps 206-210 may be employed if the dishwasher 10 includes the optional bacteria sensor 66 disposed in the dedicated reservoir 80. In process step 206, the electronic controller 70 receives a bacteria signal indicating the level of bacteria in the dedicated reservoir 80 from the bacteria sensor 66. In process step 208, the electronic controller 70 compares the value of the bacteria signal to a predetermined threshold which corresponds to the maximum acceptable level of bacteria. If the bacteria signal is greater than the predetermined threshold, the operating process 200 proceeds to process step 210, in which the electronic controller 70 energizes the reservoir drain pump 84 to drain the dedicated reservoir 80, after which the operating process 200 ends. If the bacteria signal is not greater than the predetermined threshold, the operating process 200 continues to process step 212.

After optional process step 208 (or either process steps 202 or 204, if the optional process steps are unneeded or not employed), the operating process 200 proceeds to process steps 212 and 214, in which the electronic controller 70 monitors one or more conditions of the dishwasher 10 and determines whether an application of the retained fluid containing the rinse aid is needed. In particular, process steps 212, 214 might include one or more of the door monitoring sub-process 120, the odor monitoring sub-process 130, the activation monitoring sub-process 140, or the timer monitoring sub-process 150, described above with reference to FIGS. 4A-4D. The electronic controller 70 may execute any or all of the sub-processes 120-150, sequentially or simultaneously. If the electronic controller 70 determines that an application of the retained fluid containing the rinse aid is unneeded, the operating process 200 returns to process step 212 (or to process step 206 if the dishwasher 10 includes the optional bacteria sensor 66). If the electronic controller 70 determines that an application is needed, the operating process 200 continues to process step 216 in which the electronic controller 70 operates the dedicated pump 86 via a control signal to spray at least a portion of the fluid containing the rinse aid through at least one dedicated nozzle 62 onto the wares in the dishwasher 10. Alternatively or additionally, the re-circulation pump 44 may be used to apply the fluid containing the rinse aid through the rotating spray arm 46 onto the dish racks 16, as described above.

After process step 216, the operating process 200 proceeds to process step 218, in which the electronic controller 70 determines whether the user has activated a subsequent wash cycle of the dishwasher 10. In process step 218, the electronic controller 70 monitors one of the controls 28 on the user control panel 26 which corresponds to activation of new wash cycle. If a user has activated a subsequent wash cycle, operating process 200 ends. If the user has not activated a subsequent wash cycle, the operating process 200 returns to process step 212 (or to process step 206 if the dishwasher 10 includes the optional bacteria sensor 66). Process step 218 may also be embodied as an "interrupt," in which the electronic controller 70 constantly monitors the user control panel 26 and wherein user activation of a new wash cycle will end the operating process 200 regardless of its current state.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present invention and fall within the spirit and scope of the present disclosure as defined by the appended claims.

The invention claimed is:

1. A method of preconditioning soils on wares in a dishwasher between successive wash cycles of the dishwasher, the method comprising:

retaining a fluid containing a rinse aid from an initial wash cycle of the dishwasher;

adding an additional quantity of rinse aid to the retained fluid after completion of the initial wash cycle; and applying at least a portion of the fluid containing the rinse aid to the soils on the wares in the dishwasher to precondition the wares, before a start of a subsequent wash cycle of the dishwasher;

wherein the preconditioning is interrupted upon activation of a subsequent wash cycle.

2. The method of claim 1, wherein the fluid containing the rinse aid comprises a surfactant and a sanitizing chemical.

3. The method of claim 1, wherein retaining the fluid containing the rinse aid comprises storing at least some of a rinse chemistry used in a rinsing stage of the initial wash cycle in a sump of the dishwasher, the rinse chemistry including water and rinse aid.

4. The method of claim 1, wherein retaining the fluid containing the rinse aid comprises storing at least some of a rinse chemistry used in a rinsing stage of the initial wash cycle in a dedicated reservoir of the dishwasher, the rinse chemistry including water and rinse aid.

5. The method of claim 1, wherein applying the fluid containing the rinse aid to the soils on the wares comprises spraying at least a portion of the fluid containing the rinse aid through a rotating spray arm used during a wash cycle of the dishwasher.

6. The method of claim 1, wherein applying the fluid containing the rinse aid to the soils on the wares comprises spraying at least a portion of the fluid containing the rinse aid through at least one dedicated nozzle.

7. The method of claim 1, further comprising monitoring a level of bacteria in the fluid containing the rinse aid after the fluid is retained and applying the fluid containing the rinse aid to the soils on the wares only if the level of bacteria is below a predetermined threshold.

8. A method of preconditioning soils on wares in a dishwasher between successive wash cycles of the dishwasher, the method comprising:

retaining a fluid containing a rinse aid from an initial wash cycle of the dishwasher;

adding an additional quantity of rinse aid to the retained fluid after completion of the initial wash cycle; and applying at least a portion of the fluid containing the rinse aid to the soils on the wares in the dishwasher, in response to an occurrence of an event and before a start of a subsequent wash cycle of the dishwasher.

9. The method of claim 8, wherein the event comprises a lapse of a predetermined period of time after at least one of (i) an opening and closing of a door of the dishwasher or (ii) a prior application of at least a portion of the fluid containing the rinse aid to the soiled wares.

10. The method of claim 8, wherein the event comprises detection of an odor in the dishwasher.

11. The method of claim 10, wherein detection of the odor in the dishwasher comprises an output signal of an electrochemical sensor reaching a predetermined threshold.

12. The method of claim 8, wherein the event comprises transmission of an activation signal from a user control panel.

13. A method of preconditioning soils on wares in a dishwasher between successive wash cycles of the dishwasher, the method comprising:

executing an initial wash cycle wherein a fluid containing a rinse aid from the initial wash cycle of the dishwasher is retained;

executing a subsequent wash cycle on the preconditioned wares after the completion of the initial wash cycle; and after completion of the initial wash cycle and before the executing of the subsequent wash cycle, executing a preconditioning of the wares to be washed in the subsequent wash cycle by adding an additional quantity of rinse aid to the retained fluid after completion of the initial wash cycle, and applying at least a portion of the fluid containing the rinse aid to the soils on the wares to precondition the wares.

14. The method of claim 13 wherein retaining the fluid containing the rinse aid comprises storing at least some of a rinse chemistry used in a rinsing stage of the initial wash cycle in a dedicated reservoir of the dishwasher, the rinse chemistry including water and rinse aid.

15. The method of claim 14, further comprising monitoring a level of bacteria in the fluid containing the rinse aid after the fluid is stored in the dedicated reservoir and applying the fluid containing the rinse aid to the soils on the wares only if the level of bacteria is below a predetermined threshold.

16. The method of claim 1, wherein adding the additional quantity of rinse aid to the retained fluid results in a fluid comprising approximately 1.33 milliliters of surfactant, 0.67 milliliters of bleach and 1.5 gallons of water.

* * * * *